US007075498B2

(12) United States Patent
Göttl et al.

(10) Patent No.: US 7,075,498 B2
(45) Date of Patent: Jul. 11, 2006

(54) STATIONARY MOBILE RADIO ANTENNA

(75) Inventors: Maximilian Göttl, Frasdorf (DE); Robert Kinker, Rosenheim (DE)

(73) Assignee: Kathrein-Werke KG, Rosenheim (DE)

( * ) Notice: Subject to any disclaimer, the term of this patent is extended or adjusted under 35 U.S.C. 154(b) by 83 days.

(21) Appl. No.: 10/921,292

(22) Filed: Aug. 19, 2004

(65) Prior Publication Data

US 2005/0264463 A1 Dec. 1, 2005

(30) Foreign Application Priority Data

May 27, 2004 (DE) ..... 10 2004 025 904

(51) Int. Cl.
*H01Q 21/26* (2006.01)

(52) U.S. Cl. ..... 343/797

(58) Field of Classification Search ..... 343/793, 343/797, 798, 808

See application file for complete search history.

(56) References Cited

U.S. PATENT DOCUMENTS

| | | | | |
|---|---|---|---|---|
| 5,629,713 | A * | 5/1997 | Mailandt et al. | 343/808 |
| 5,710,569 | A | 1/1998 | Oh et al. | 343/817 |
| 6,025,812 | A * | 2/2000 | Gabriel et al. | 343/797 |
| 6,195,063 | B1 | 2/2001 | Gabriel et al. | 343/797 |
| 6,313,809 | B1 | 11/2001 | Gabriel et al. | 343/797 |
| 6,333,720 | B1 * | 12/2001 | Gottl et al. | 343/810 |
| 6,339,407 | B1 * | 1/2002 | Gabriel et al. | 343/797 |
| 6,734,829 | B1 | 5/2004 | Gottl | 343/815 |
| 2003/0011529 | A1 * | 1/2003 | Gottl | 343/795 |

FOREIGN PATENT DOCUMENTS

| | | | |
|---|---|---|---|
| DE | 196 27 015 | C2 | 8/1998 |
| DE | 198 60 121 | A1 | 7/2000 |
| DE | 199 31 907 | C2 | 8/2001 |
| EP | 0 895 303 | B1 | 2/1995 |
| EP | 1 082 781 | B1 | 3/2002 |
| EP | 0 916 169 | B1 | 8/2002 |
| EP | 1 082 782 | B1 | 7/2003 |
| GB | 982155 | * | 2/1965 |
| WO | WO 98/01923 | | 1/1998 |
| WO | WO 98/36472 | | 8/1998 |
| WO | WO98/54787 | | 12/1998 |
| WO | 99/62138 | | 12/1999 |
| WO | 01/04991 | A1 | 1/2001 |
| WO | WO 01/04991 | | 1/2001 |
| WO | WO 02/41451 | * | 5/2002 |

* cited by examiner

*Primary Examiner*—Hoang V. Nguyen
*Assistant Examiner*—Leith A. Al-Nazer
(74) *Attorney, Agent, or Firm*—Nixon & Vanderhye P.C.

(57) ABSTRACT

An improved antenna arrangement includes a passive and electrically conductive element comprising a beamforming element. The at least one beamforming element is subdivided into at least two sections, specifically a mounting section and an operating section, which is connected to the area of the mounting section located further away from the reflector.

18 Claims, 4 Drawing Sheets

STATIONARY MOBILE RADIO ANTENNA

FIELD

The technology herein relates to stationary mobile radio antennas.

BACKGROUND AND SUMMARY

Antennas in particular in the form of stationary mobile radio antennas have been known for a long time.

By way of example, EP 1 082 781 B1 discloses an antenna array having two or more primary antenna element modules which are arranged vertically one above the other and transmit and receive in one position, for example with a vertical alignment. Each individual antenna element may in this case comprise dipole antenna elements or dipole antenna element arrangements.

In addition, antennas, in particular in the form of antenna arrays, are also known which transmit and/or receive on two mutually orthogonal polarization planes. Dual-polarized antennas such as these are known, for example, from DE 198 60 121 A1. In this case, the two mutually perpendicular polarization planes are preferably rotated at an angle of 45° with respect to the horizontal (or vertical). The expression so-called X polarization or X alignment of the antenna elements is also frequently used in this case.

These antennas or antenna arrays likewise once again preferably use dipole antenna elements, for example cruciform dipole antenna elements or else dipole squares. In addition, so-called vector dipoles may also be used, such as those which are known, in principle, from DE 198 60 121 A1. These dipole structures represent a dual-polarized antenna element arrangement which, from the electrical point of view, is constructed in the form of a cruciform dipole and, from the physical point of view, is approximately in the form of a square structure.

Against the background of these fundamentally known antenna elements and antenna element arrangements, the technology herein provides an improved antenna, in particular in the form of an exemplary illustrative non-limiting stationary antenna for a base station for the mobile radio range, which is equipped with a device for carrying out beamforming. An exemplary illustrative non-limiting implementation allows better shaping of far-field polar diagrams to be produced for antennas such as these.

Within the scope of exemplary illustrative non-limiting implementations, it is now possible to specifically improve the shaping of the far-field polar diagrams of corresponding antennas.

In an exemplary illustrative non-limiting implementation, the shaping of the far-field polar diagram may be carried out just for a single antenna element, in particular even if there is only one antenna element emitting one polarization. In the same way, however, the technology herein can also be used for a dual-polarized antenna element or for a dual-polarized antenna element arrangement. The technology herein is not just restricted to a single-band antenna but can also be used and provided for a dual-band antenna or, in general form, for a multiband antenna.

Exemplary illustrative non-limiting implementations are also distinguished in that the desired improvement that has been explained can be achieved by comparatively simple and low-cost measures. Furthermore, the measure that produce the improvement can be used specifically and, in particular, can be associated with individual antenna elements.

In this case, the exemplary illustrative non-limiting measures can be used not just for dual-polarized antennas with dipole antenna elements, but, for example, also for patch antennas. In principle, there are no restrictions on the specific antenna element forms.

The exemplary illustrative non-limiting solution is distinguished, inter alia, by the provision of a passive electrically conductive element, which is conductively connected or capacitively coupled at least indirectly to the electrically conductive reflector.

The exemplary illustrative non-limiting passive electrically conductive element, which is additionally provided at least for one antenna element or one antenna element arrangement, is preferably subdivided into at least two parts and comprises a mounting section, which preferably originates from the reflector and is electrically connected or capacitively coupled to it, and in this case is preferably at least indirectly mechanically connected to the reflector. A so-called operating section, which is preferably arranged on a plane running parallel to the reflector, is then provided on the side of the mounting section facing away from the foot point of the mounting section (which is located in the vicinity of the reflector or of the reflector plane). This operating section may, moreover, be arranged such that it differs from the alignment of the reflector plane at least in an angular range of ±20°, and preferably less than ±10°, that is to say running at an angle to the reflector plane.

The technology herein provides for this operating section to have a length of preferably 0.2λ up to and including 1.0λ, where λ corresponds to the wavelength in the frequency range or frequency band to be transmitted, preferably the mid-wavelength of the frequency range to be transmitted. The operating plane itself may be arranged above or below the antenna element plane of the active antenna element to be influenced by it. There is no restriction to this. However, the length of the mounting section, which is greater than the distance between the operating section of the passive electrically conductive element on the reflector, should not exceed a maximum value corresponding to twice the wavelength mentioned above in one exemplary illustrative implementation.

The material thickness and the transverse dimensions transversely with respect to the extent direction of the electrically conductive additionally provided beamformer element should preferably be less than 0.1 times the operating wavelength, preferably the mid-operating wavelength of the element to be influenced.

In principle, mobile radio antennas which comprise decoupling elements that are in the form of rods and extend essentially at right angles to the reflector plane are known from the prior art, for example also from WO 01/04991 A1. These passive, electrically conductive coupling elements are conductively connected to the reflector plate, or are capacitively coupled at their foot point to the conductive reflector. However, these elements are electrically conductive passive decoupling devices, in order to achieve better decoupling between two dual-polarized antenna elements or antenna element devices.

However, an aim of the exemplary illustrative non-limiting implementation herein is not merely to ensure a decoupling element for improvement of the decoupling between two dual-polarized emission planes but, instead, an aim is to change and to shape the polar diagram in a desired manner, for example even in the case of an antenna element device which emits only a single polarization plane, particularly when viewed in the far field. The technology herein therefore also provides for the operating section of the exemplary illustrative non-limiting electrically conductive beamforming element to run such that it is aligned at least essentially or approximately on the operating plane mentioned above, which is preferably parallel to the reflector plane, in the polarization direction of the element to be influenced. In an exemplary illustrative non-limiting implementation, discrepancies of preferably less than 20% and in particular of less than 10%, can also still bring about the desired success.

BRIEF DESCRIPTION OF THE DRAWINGS

These and other features and advantages will be better and more completely understood by referring to the following detailed description of exemplary non-limiting illustrative implementations in conjunction with the drawings, of which.

DETAILED DESCRIPTION

A first exemplary illustrative non-limiting implementation of an antenna will be explained in more detail in the following text with reference to FIGS. 1 and 2.

Figure 1:
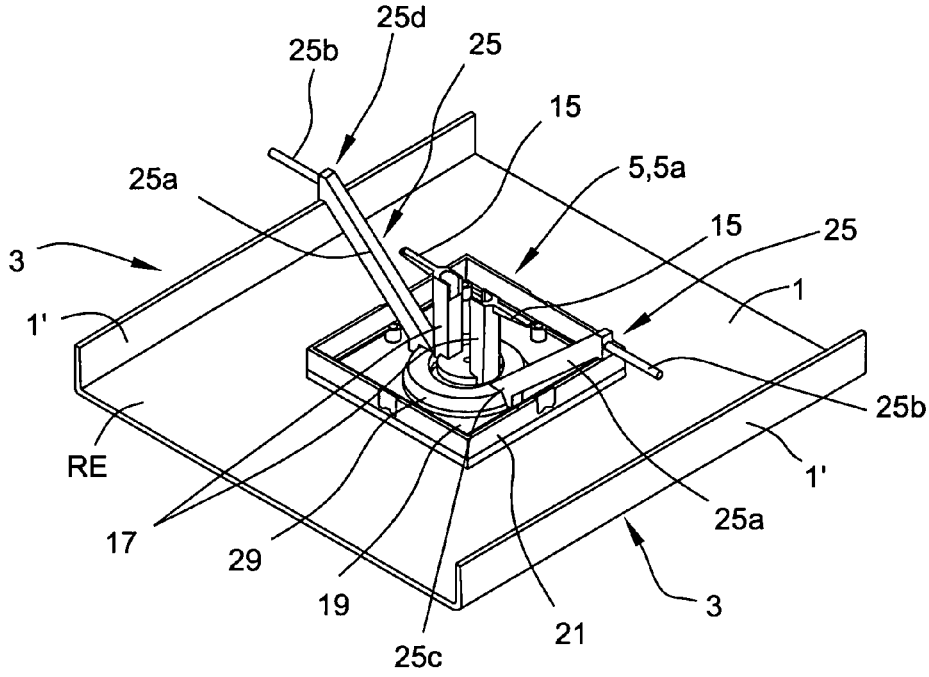
FIG. 1: shows a schematic, perspective illustration of an exemplary illustrative non-limiting antenna arrangement having a dipole antenna element and an element or beamforming element.
Figure 2:
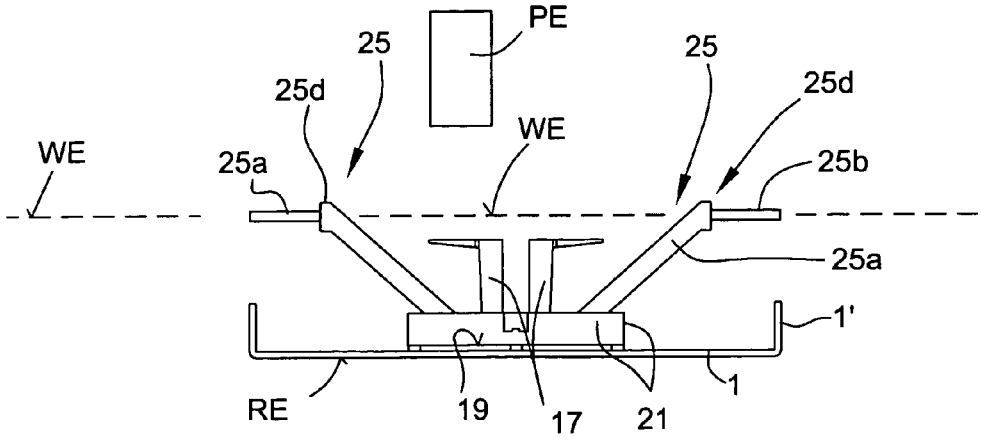
FIG. 2: shows a schematic front view along the arrow A illustrated in FIG. 1.

The antenna shown in FIGS. 1 and 2 has a reflector arrangement or a reflector 1 which is conductive.

An antenna element arrangement 5 which, in the illustrated exemplary implementation, comprises a single antenna element 5*a* is preferably provided in the central area between the two longitudinal side areas 3. The single antenna element 5*a* in this exemplary illustrative non-limiting implementation is formed from a dual-polarized dipole antenna element which emits two mutually perpendicular planes (that is to say it transmits or receives two mutually perpendicular planes).

The reflector 1 is essentially planar, at least in the area of the antenna element arrangement 5. In the illustrated exemplary non-limiting implementation, projecting reflector webs or wall sections 1' are provided running in the emission direction on the longitudinal side areas 3 transversely with respect to the reflector plane. These need not necessarily be arranged at the outer lateral end of the reflector 1, but can also be provided further inwards. In addition, additional webs or outer side boundary sections may be provided, such as those which are known, for example, from the prior publications WO 99/62138 A1, U.S. Pat. No. 5,710,569 A, or EP 0 916 169 B 1. The webs 1' which have been mentioned may in this case be aligned at right angles to the reflector plane, or else at some other, obliquely running angle.

The explained antenna arrangement is generally installed such that the reflector 1 runs lying on a vertical plane and, in the process, the webs 1' which have been mentioned and are arranged in the side area likewise run in the vertical direction. The linear-polarized antenna element or the linear-polarized antenna element arrangement may also be aligned differently, for example such that the polarization plane does not lie on a horizontal plane, but on some other plane in contrast to this, for example in the vertical direction. In this case, the antenna element arrangement would then be aligned with the beamforming element (which will be explained later) rotated through 90°, so that the dipole antenna element then runs parallel to the webs 1' which are provided at the sides.

The antenna element 5 is constructed essentially in a known manner and has two dipole halves 15, which are held via a dipole mounting device in the form of a balancing device 17. In the illustrated exemplary non-limiting implementation, the antenna element arrangement is arranged in an array 19 on the reflector 1 which, in a plan view, is at least approximately square and has a circumferential web or a circumferential wall 21.

A passive electrically conductive element 25, which is sometimes also referred to in the following text as a beamforming element 25, is now provided, in particular for shaping of the polar diagram, especially with regard to the far field, but also in order to improve the matching of the active element, that is to say of the antenna element. This beamforming element 25 is subdivided at least approximately into two sections in the illustrated exemplary non-limiting implementation, specifically a mounting section 25*a* and a so-called operating section 25*b*. It can also be seen that the mounting section 25*a* which, like the operating section 25*b*, is electrically conductive or is provided with an electrically conductive surface or partially with an electrically conductive surface, likewise contributes to the overall effect but that is to say the effect is not provided solely by the so-called operating section 25*b*.

The mounting section 25*a* is preferably arranged directly electrically conductively on the reflector 1, and is electrically and preferably mechanically connected to it. However, the link may also be provided capacitively, so that the mounting section 25*a* and, in particular its foot point 25*c*, are capacitively coupled to the reflector 1. The mechanically and/or electrically conductive or electrically capacitive connection or coupling to the reflector 1 may, however, also be provided indirectly, by providing a corresponding link via an additional intermediate element or to the foot point of the balancing device 17. In the illustrated exemplary non-limiting implementation, a conductive ring structure 29 is provided circumferentially on the reflector 1 and at the foot point of the balancing device 17, to which conductive ring structure 29 the foot section of the mounting section 25*a* is mechanically and electrically linked (or, in the case of capacitive coupling, is in this case capacitively coupled with the interposition of an insulator or dielectric).

As can be seen in particular from the side view in FIG. 2, a so-called transition area or transition point 25*d* is adjacent to the upper end of the mounting section 25*a* of the so-called operating section 25*b*, which preferably lies on an operating plane WE. This operating plane WE is preferably aligned parallel to the plane of the reflector 1, that is to say at least parallel to that reflector section which is arranged in the area of the antenna elements or of the beamforming element. The operating section 25*b* or its essential or major part need not, however, necessarily be aligned exactly parallel to the relevant reflector section or reflector 1. Discrepancies with regard to the relevant section of the reflector of preferably less than ±20°, in particular of less than ±10°, still lead to the desired effects.

Owing to the configuration and arrangement of the mounting section, the length of the mounting section from the foot point 25*c* located at the bottom up to the level of the operating plane, that is to say in particular to the transition area 25*d*, is longer than the distance between the reflector plane RE and the operating plane WE. The mounting section 25*a* should in this case be larger than the distance between the operating plane WE and the reflector plane RE at least in the area of the antenna element arrangement or in the area of the beamforming element 25 to be influenced via it. The length of the mount should, however, preferably not exceed twice the wavelength (2λ) of the associated operating mid-wavelength of the antenna element arrangement 5, with this wavelength corresponding to the lower or upper end of the frequency band to be considered, preferably the wavelength in the mid-frequency band.

The length of the operating section 25*b* in the direction of the operating plane WE should preferably correspond to 0.2λ, up to and including ±1.0λ, with respect to the operating wavelength (in particular the mid-operating wavelength of a frequency band to be transmitted).

The operating plane itself may be located not only underneath but also above or at the same level as the active antenna element, that is to say the dipole halves 15. In this case, the operating plane (in particular in the area of the operating section 25*b*) should be located at a distance of preferably 0.2λ up to and including 1.5λ, where λ once again corresponds to the wavelength of the frequency band to be transmitted, preferably the mid-wavelength of the frequency band to be transmitted.

The exemplary non-limiting implementation shown in FIGS. 1 and 2 also shows that the operating section 25*b* is arranged to be copolar, that is to say it is aligned in the direction of the polarization plane. In this case, the operating section 25*b* is not only located parallel, but also on the polarization plane PE of the antenna element arrangement 5 to be influenced via it. In the exemplary illustrative non-limiting implementation shown in FIGS. 1 and 2, the polarization plane PE thus remains at right angles to the reflector 1, with the dipole halves 15 being located on this polarization plane PE and in this case, in an exemplary illustrative non-limiting implementation, the mounting section 25*a* as well as the operating section 25*b* of the beamforming elements 25, being located there as well.

From the illustrated exemplary illustrative non-limiting implementation, it can also be seen that two such beamforming elements 25 are provided for the single dipolar antenna element that is provided, which beamforming elements 25 are arranged symmetrically to a symmetric plane positioned at a right angle to the reflector 1 as well as at right angle to the polarization plane PE running through the center of the antenna element arrangement 5.

Figure 3:
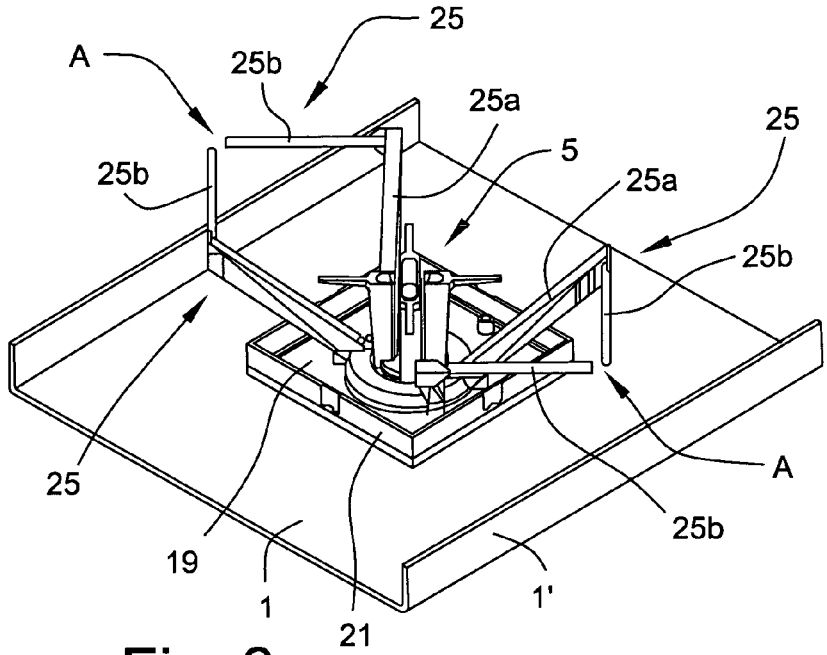
FIG. 3: shows an exemplary illustrative non-limiting implementation, modified from that in FIGS. 1 and 2, of a dual-polarized antenna element with a corresponding exemplary illustrative non-limiting arrangement of two elements for polar diagram shaping for each polarization.

The following text refers to a modified exemplary illustrative non-limiting implementation, as shown in FIG. 3.

This exemplary illustrative non-limiting implementation-likewise once again relates to an antenna element arrangement 5 which, in this exemplary non-limiting implementation, comprises two individual dipole antenna elements 5*a* and 5*b*, however, which are designed in the form of a dipole cruciform. The two dipole antenna elements which are aligned at right angles to one another are in this case preferably arranged rotated through an angle of +45° with respect to the horizontal or vertical plane, so that this antenna element arrangement has two polarization planes PE, which are at right angles to one another, at +45° and −45°.

In this exemplary illustrative non-limiting arrangement, two beamforming elements 25 are in each case provided for each dipole half, that is to say for each polarization plane.

The associated mounting sections 25*a* are in this case preferably each once again located on one of the relevant polarization planes of the associated dipole arrangement. The operating section 25*b*, which is adjacent to the upper end of the respective mounting section 25*a*, is in this case arranged at a right angle to the polarization plane (in which the associated mounting section 25*a* is arranged running), that is to say running parallel to the polarization plane of the other mounting section 25*a*. The length and size ratios are comparable to the exemplary illustrative non-limiting implementation shown in FIGS. 1 and 2. Thus, in this arrangement, the two side mounting sections 25*a* diverge from one another in the direction of the operating plane WE, starting from the reflector plane, with the operating sections 25*b* which are adjacent to the upper end of the mounting section 25*a* running toward one another on a common operating plane WE and, in the illustrated exemplary non-limiting implementation, ending at a short distance A from one another.

In contrast to the illustrated exemplary non-limiting implementation, however, not only FIGS. 1 and 2 but also FIG. 3 show the arrangement in such a way that the mounting section 25*a* does not necessarily lie on the respectively associated polarization plane PE, but also runs out of this plane between its foot point and its transition area to the associated operating section 25*b*, or, overall is arranged at an oblique angle to the polarization plane. Discrepancies of less than ±20°, in particular of less than ±10°, are possible in this case. The more critical factor is, in particular, that the operating sections 25*b* each run parallel to an associated polarization plane PE (being located at a lateral distance from the polarization plane of the associated antenna element), with discrepancies of less than ±20°, in particular of less than ±10°, with respect to the polarization plane also being possible here. Discrepancies between the operating plane WE and the alignment of the operating sections 25*b* with respect to the reflector plane can also move in the same range, that is to say this discrepancy can also be less than ±20°, and in particular ±10°.

Figure 4:
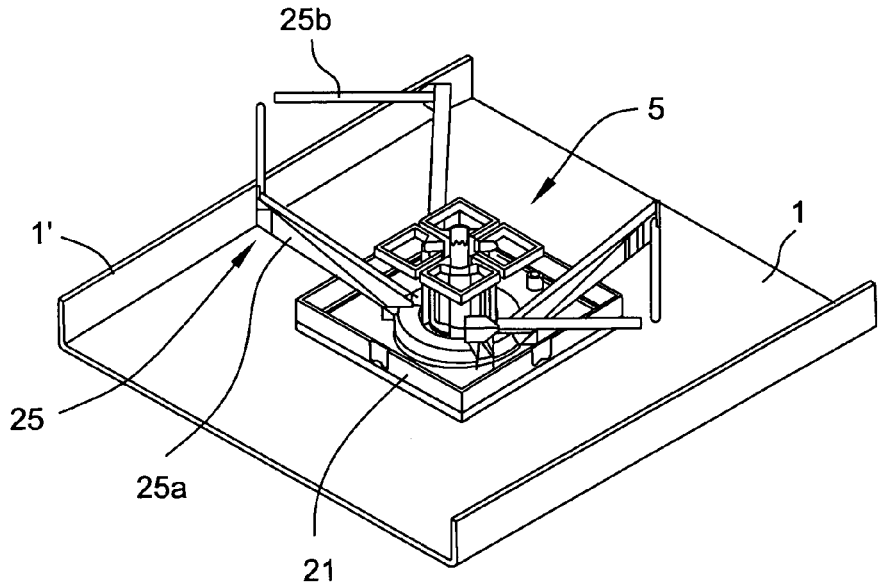
FIG. 4: shows an illustration corresponding to that in FIG. 3 with a differently configured exemplary illustrative non-limiting dual-polarized antenna element arrangement.

Once again, FIG. 4 shows another different exemplary illustrative non-limiting implementation, which differs from that shown in FIG. 3 in that a square compact antenna element is used as an antenna element arrangement 5 polarized in a cruciform shape. This is an antenna element arrangement as is known in principle from DE 198 60 121 A1. The outer corner points of the conductive structure may in this case be open (as has been described in DE 198 60 121 A1), or may be closed by means of an insulator or dielectric, or else electrically conductively. In this context, reference should be made to known solutions. Furthermore, in this case, the polarization planes are aligned at an angle of +45° and −45° with respect to the horizontal or vertical. The dipole antenna element structure, which is cruciform from the electrical point of view, in FIG. 4 is an antenna element arrangement which in some cases is also referred to as a vector antenna element, cross-vector antenna element, or antenna element arrangement.

Figure 5:
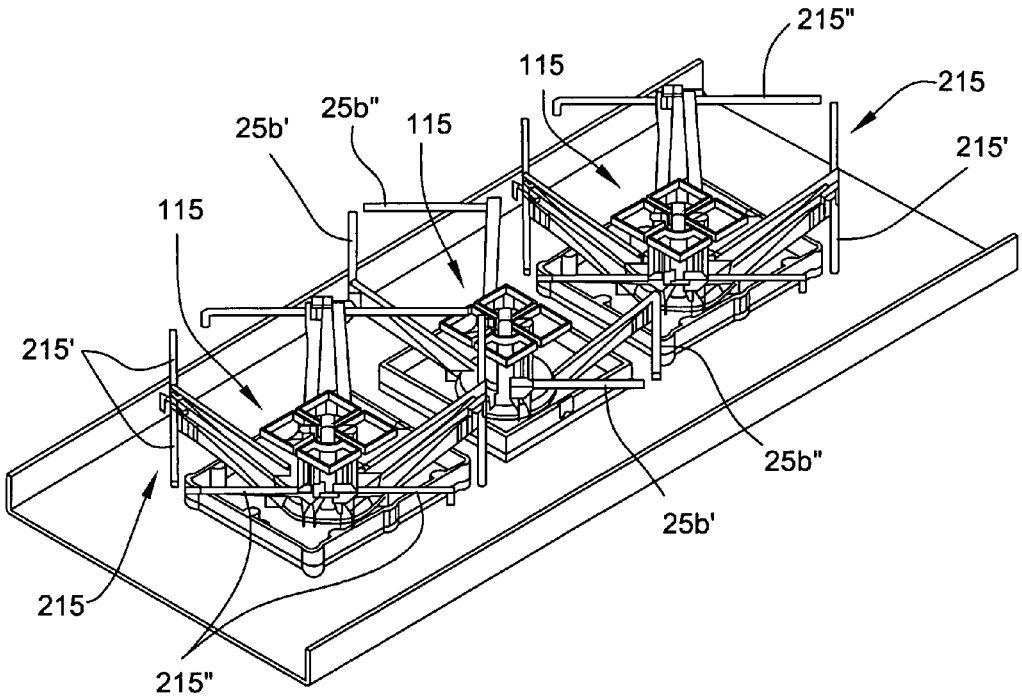
FIG. 5: shows a corresponding perspective illustration of a dual-polarized two-band antenna arrangement with the beamforming device shown in FIG. 4.
Figure 7:
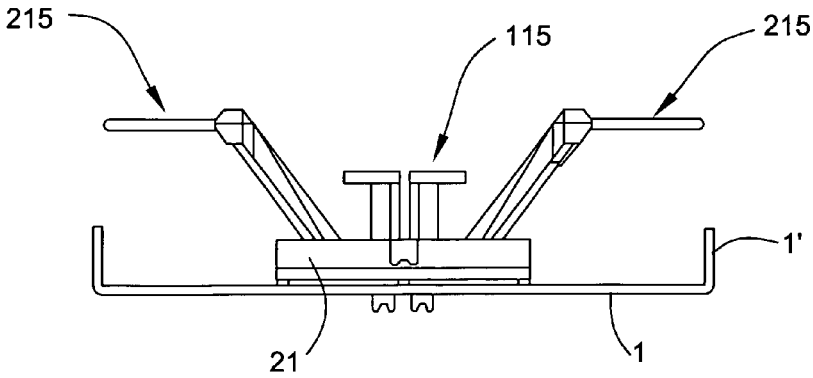
FIG. 7: shows a cross-sectional illustration transversely with respect to the vertical alignment of the exemplary illustrative non-limiting reflector shown in FIG. 5, through the central antenna element and the beamforming element.
Figure 6:
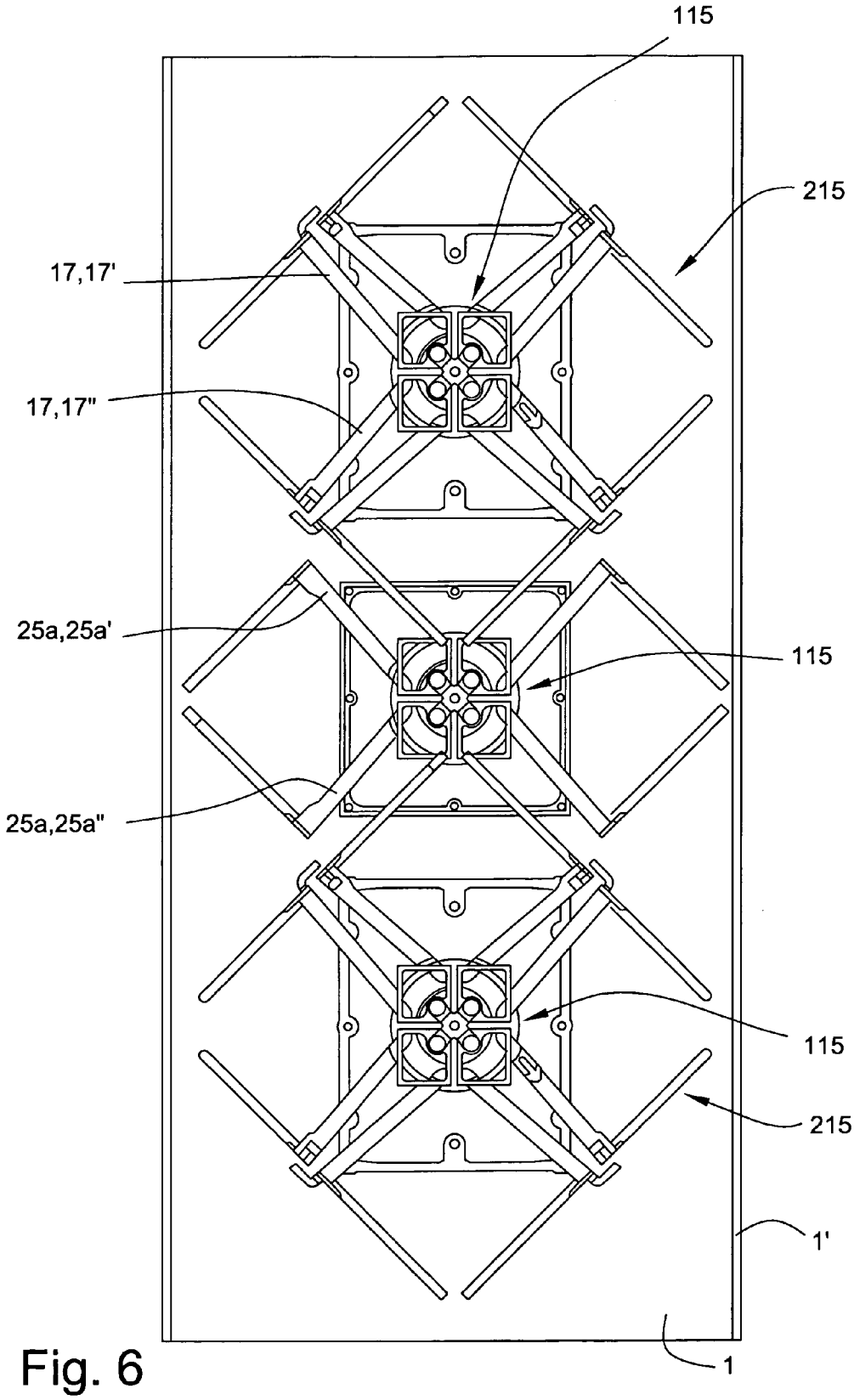
FIG. 6: shows a schematic plan view of the exemplary illustrative non-limiting implementation shown in FIG. 5.

FIGS. 5 to 7 serve only to show that, for example, a dual-band antenna array, in particular for a stationary mobile radio antenna, may have a conventional antenna element arrangement with antenna elements 115 for a relatively high frequency band, and antenna element arrangements 215 for transmission in a relatively low frequency band. The antenna element arrangement 215 for transmission in the relatively low frequency band in each case comprises two pairs of dipoles 215' and 215", which are arranged parallel to one another and are arranged so as to produce a dipole square. In this case, the antenna elements which are provided for transmission in the relatively high frequency band are arranged centrally in these dipole squares, with their dipole antenna elements lying on a plane which is closer to the reflector plane RE than the dipole elements 215' and 215" of the antenna elements which emit in the higher frequency band. The antenna element arrangement 215 is intended for transmission and/or reception in the relatively low frequency band (this may preferably be a frequency band operating, for example, at half the frequency of the frequency in the relatively high frequency band. However, there is no absolute necessity for any such restriction). Both the inner antenna elements 215 and the outer antenna elements 115 are arranged and aligned such that both antenna element types emit on two mutually perpendicular polarization planes which, in the illustrated exemplary illustrative non-limiting implementation, are aligned at an angle of +45° and −45°, respectively, to the horizontal or vertical plane.

An additional antenna element arrangement 115 is then also arranged between the centers of the two antenna element arrangements 115 on the reflector 1, for transmission in the relatively high frequency band (in particular for transmission in a frequency band that is twice as high as the low frequency band, the antenna element sequence and thus the antenna element separation between the antenna elements for the relatively high frequency band is thus only half as great as for the relatively low frequency band). If those beamforming elements 25 which have already been described for the exemplary non-limiting implementation shown in FIG. 4 and in this case also used for the central antenna element arrangement 115, that is to say for the antenna element arrangement 115 which is in each case located between two antenna element arrangements 215 that are provided for the relatively low frequency range, then this results in a structure corresponding to the example shown in FIG. 5.

The corresponding plan view illustrated in FIG. 6 shows that the beamforming elements 25 together with the respective mounting section 25*a* and the operating section 25*b* adjacent to it, are in this exemplary non-limiting implementation shaped such that the respective mounting section 25*a* corresponds to that part of the mount or of the balancing device 17 with a corresponding dipole arrangement for the antenna element arrangement 115 which emits in the relatively low frequency band, and the operating section 25*b* (which is then adjacent to the mounting section 25*a*) of a respectively associated dipole half 15' of an adjacent antenna element arrangement 215, that is to say can be aligned running parallel thereto. Thus, in this case, the mounting section 25'*a* essentially has the same length, the same alignment and gradient parallel to the one part of the mounting section or of the balancing device 17', and the further mounting section 25" *a* is arranged and positioned in a corresponding alignment, with a 90° offset in a plan view, otherwise with the same gradient and a similar or comparable length to the associated part of the mounting section or of the balancing device 17" for the antenna elements 215, that is to say also at the same distance from the vertical side edge 1' of the reflector 1' and with the same lateral distance from one of the central and vertical planes, running at right angles to the reflector plane. Thus, in this exemplary illustrative non-limiting implementation, the operating sections 25*b* are arranged in an operating plane WE parallel to the reflector, on which the dipole elements 15' of the dipole antenna elements 215 which are intended for the relatively low frequency band also come to rest. In addition, the length of the operating sections 25*b* corresponds approximately to the length of the respective dipole half for the relatively low frequency band, or differs by less than 40%, in particular by less than 30%, less than 20% or even less than 10%, from it. Finally, the arrangement of the operating sections with respect to the reflector is also comparable to the arrangement of the dipole halves of the adjacent antenna elements for transmission in the low frequency band. In other words, the operating sections are arranged above the reflector, such that, for example, the dipole half 215" starts and ends approximately at the same distance from the adjacent side boundary at 1' of the reflector at which the correspondingly parallel dipole half 215" of the antenna element for the relatively high frequency band likewise starts and ends.

In a corresponding manner, the second operating section 25*b'* which is in each case at right angles to this, correspondingly same relative position is arranged in the transverse direction of the reflector, as the parallel dipole half 215' of an adjacent antenna element for the relatively low frequency band.

This allows particularly good results to be achieved since this allows not only shaping of the far-field polar diagram for not just one but also for two or more polarizations, and the use of the corresponding beamforming elements 25 furthermore makes it possible to achieve an improvement in the isolation between the polarizations, and hence an improvement in the matching of the respective active element for the relatively high frequencies.

While the technology herein has been described in connection with exemplary illustrative non-limiting implementations, the invention is not to be limited by the disclosure. The invention is intended to be defined by the claims and to cover all corresponding and equivalent arrangements whether or not specifically disclosed herein.

The invention claimed is:

1. A stationary mobile radio antenna comprising:

a reflector, at least one antenna element for operation in at least one polarization plane (PE), at least one passive, electrically conductive element, which is at least indirectly electrically conductively connected or electrically capacitively coupled to the reflector, the passive, electrically conductive element comprising a beamforming element, the at least one beamforming element being subdivided into at least two sections, including a mounting section and an operating section, which is connected to the area of the mounting section located further away from the reflector, the operating section being disposed on an operating plane (WE), the operating plane (WE) running parallel to, or differing from being parallel to by less than ±20°, at least in that section of the reflector in the area of the beamforming element and/or of the antenna element to be influenced thereby, the length of the operating section being between 0.2λ and 1.0λ, where lambda (λ) is a wavelength in the frequency band to be transmitted, the operating section or the operating plane (WE) being at a distance from the reflector in the area of the operating section, which distance is greater than or equal to 0.2λ and is less than or equal to 1.5λ, where lambda λ is the wavelength of the frequency band to be transmitted, the length of the mounting section being shorter than a maximum of twice the wavelength 2 λ of the frequency band to be transmitted, the operating section being aligned parallel to, or differing by less than ±20° from being parallel to the associated polarization plane (PE) of the antenna elements to be influenced thereby.

2. The antenna as claimed in claim 1, wherein the material thickness or the cross-sectional size of the mounting section and/or of the operating section is less than 0.1λ, where lambda λ is the wavelength of the frequency band to be transmitted.

3. The antenna as claimed in claim 1, wherein the mounting section lies at least essentially on the polarization plane (PE) of the antenna element arrangement.

4. The antenna as claimed in claim 1, wherein the operating section runs parallel to the dipole to be influenced via it, or at an angle of less than 20° to it.

5. The antenna as claimed in claim 1, wherein the length of the mounting section is greater than the distance between the operating section and the reflector.

6. The antenna as claimed in claim 1, wherein the foot point of the mounting section as well as its transition area or transition point which is located at a distance from the reflector and at which the operating section starts, is located at least approximately on the same polarization plane (PE) as the antenna element.

7. The antenna as claimed in claim 1, wherein, in the case of a linear-polarized antenna element, the mounting section and the operating section of the beamforming element lie substantially on the polarization plane (PE) of the linear-polarized antenna element.

8. The antenna as claimed in claim 1, wherein at least two beamforming elements are provided for each polarization.

9. The antenna as claimed in claim 8, wherein the at least two beamforming elements which are provided at least for each polarization are arranged symmetrically with respect to a plane of symmetry which runs at right angles to the polarization plane (PE) and at right angles to the reflector through the center on the associated antenna element.

10. The antenna as claimed in claim 1, wherein a dual-polarized antenna element arrangement comprises at least two beamforming elements.

11. The antenna as claimed in claim 10, wherein the operating section runs parallel to one of the two mutually perpendicular polarization planes.

12. The antenna as claimed in claim 10, wherein the mounting section runs on a polarization plane W (PE).

13. The antenna as claimed in claim 10, wherein the operating section is aligned at least approximately at right angles, to the mounting section on which it is mounted.

14. The antenna as claimed in claim 1, wherein, in a plan view of a dual-band or multiband antenna, at least parts of the operating sections are arranged such that they are located at least approximately at the same lateral distance from the side boundary of the reflector as the associated parallel dipole halves of adjacent antenna elements for transmission in a lower frequency band.

15. The antenna as claimed in claim 14, wherein the operating sections lie on an operating plane (WE) which corresponds to the antenna element plane of the antenna elements which emit in a higher frequency band.

16. The antenna as claimed in claim 1, wherein the operating sections are arranged parallel to the dipole halves of adjacent antenna elements which are provided for transmission in a lower frequency band.

17. The antenna as claimed in claim 1, wherein, in a plan view of the antenna arrangement, the operating section lies on an extension of the associated mounting section.

18. The antenna as claimed in claim 1, wherein the alignment of the operating section is aligned to be copolar with the respective active element, in particular in the form of an antenna element, to be influenced thereby, on the polarization plane (PE) of an antenna element.

* * * * *